United States Patent [19]

Inaida et al.

[11] Patent Number: 4,740,727

[45] Date of Patent: Apr. 26, 1988

[54] CATHODE RAY TUBE APPARATUS WITH COOLANT EXPANSION CHAMBER

[75] Inventors: Kazuo Inaida; Tomosuke Chiba, both of Chiba; Satoshi Ozawa, Saitama, all of Japan

[73] Assignee: Sony Corporation, Tokyo, Japan

[21] Appl. No.: 877,343

[22] Filed: Jun. 23, 1986

[30] Foreign Application Priority Data

Jun. 25, 1985 [JP] Japan ..... 60-137037

[51] Int. Cl.[4] ..... H01J 29/86

[52] U.S. Cl. ..... 313/36; 313/44; 313/45; 313/477 R

[58] Field of Search ..... 313/35, 36, 44, 45, 313/477 R; 358/60, 64, 237, 242, 250

[56] References Cited

U.S. PATENT DOCUMENTS 4,511,927 4/1985 Bauer ..... 358/250
4,529,905 7/1985 Ohkoshi et al. ..... 313/35
4,568,852 2/1986 Kobayashi et al. ..... 313/36
4,634,918 1/1987 Kato et al. ..... 313/36

FOREIGN PATENT DOCUMENTS 0202119 11/1986 European Pat. Off. .
58-126650 7/1983 Japan .
58-192240 11/1983 Japan .
60-032237 2/1985 Japan .

*Primary Examiner*—David K. Moore
*Assistant Examiner*—K. Wieder
*Attorney, Agent, or Firm*—Ronald P. Kananen

[57] ABSTRACT

An improved structure for cooling a cathode ray tube apparatus for projecting color images includes a cooling medium contained in a space defined by a front panel of the cathode ray tube, a front panel or lens, and a metallic frame for transferring heat from the tube to the frame. An improvement includes an air or expansion chamber communicating with the defined cooling medium space to permit expansion of the heated cooling medium into the chamber, while preserving the distance between the front panel of the tube and the lens.

20 Claims, 3 Drawing Sheets

CATHODE RAY TUBE APPARATUS WITH COOLANT EXPANSION CHAMBER

BACKGROUND OF THE INVENTION

1. Field of the Invention

The present invention relates to a cathode ray tube apparatus and, more specifically, to an apparatus for cooling a cathode ray tube, particularly a high-luminance cathode ray tube used for color projectors. Still more particularly, this invention relates to an improved space-defining structure for enhancing the cooling effect on the front panel of a cathode ray tube which includes an expansion chamber outside of the field of vision of the cathode ray tube for permitting expansion of the cooling medium confined within the space and chamber during prolonged operation.

2. Description of the Prior Art

A cathode ray tube used for color projectors is constructed so that a high luminance optical image reproduced from a video tape recorder, for example, can be obtained by increasing the energy of an electron beam colliding with a surface of a fluorescent screen. Such a fluorescent screen is made from a panel, such as a glass panel, on which is applied a fluorescent substance. However, since the front panel or the glass panel of the cathode ray tube on which the fluorescent substance is applied is formed relatively thick so as to absorb x-rays, a significant amount of heat is readily generated from the front panel. When the cathode ray tube is in operation, the generated heat is not effectively emitted, resulting in a temperature rise in the front panel, and in particular in the center of the front panel.

As a result of such a significant temperature rise, a phenomenon known as thermal extinguishment occurs. According to such phenomenon, the luminescence of a fluorescent substance decreases with increasing temperature on the front panel. Thus, it is well known that the presence of this phenomenon will deteriorate the white balance of the cathode ray tube and deteriorate the picture quality of an optical image, and in particular that of a projected optical image.

In addition, when the temperature on the front panel of a cathode ray tube rises, the fluorescent substance applied to the front panel may peel away or be disengaged from the front panel. Accordingly, a temperature rise of the front panel creates an additional problem for attention.

To address these problems, an improved cathode ray tube apparatus has been proposed in Japanese Published Utility Model Application No. 59-7731. In that published application, a device is shown in which a space formed between the front panel of a cathode ray tube and a transparent panel located forward of the front panel is filled with a cooling medium to conduct heat to a metal frame associated with the cathode ray tube to serve as a heat sink. In the cathode ray tube apparatus as described, however, a sufficient quantity of the cooling medium is used to enhance the cooling effect of the front panel and generally fills the confined cooling medium space. The cooling medium, on the other hand, readily expands in volume with increasing temperature on the front panel. Thus, another problem exists in accommodating the expansion of the cooling medium in that the cathode ray tube apparatus may explode or the frame may become deformed due to high temperature. In the situation in which the front panel, the transparent panel, or the metallic frame are deformed, another problem results in that when the transparent panel is replaced with a lens, the distance between the front surface and the lens changes resulting in the projection of an unfocused optical image on a screen.

The arrangement of the prior art cathode ray tube apparatus will be described in further detail hereinafter with reference to the attached drawings and in the detailed description.

It is thus an overall object of the present invention to provide a cathode ray tube apparatus in which heat generated on the front panel can effectively be conducted to the metallic frame without deforming the front panel and the metallic frame and thus avoid deteriorating the quality of optical images.

It is an additional object of this invention to provide a cooling apparatus for a cathode ray tube which defines an air or expansion chamber associated with a defined space relative to the surface of the cathode ray tube to permit expansion of the cooling medium from the space to the chamber.

It is still another object of the invention to provide a structure for a cathode ray tube in which an expansion chamber is provided to accommodate expansion of a heated cooling medium in a direction which leaves unaffected the distance between the tube and its lens.

These and other objects of the invention will become apparent from the detailed description of the invention which follows, taken in conjunction with the accompanying drawings.

SUMMARY OF THE INVENTION

Directed to overcoming the problems with the prior art apparatus and to achieving the foregoing and other objects, a cathode ray tube apparatus according to the invention comprises a cathode ray tube having a metallic frame mounted on a front surface periphery of the cathode ray tube. A lens is mounted on a front surface periphery of the metallic frame to define a cooling medium space bounded by the front surface of the cathode ray tube, an inner surface of the metallic frame, and a rear surface of the lens to provide an air or expansion chamber within the space. A transparent liquid, preferably ethylene glycol, is positioned within such space so that the transparent liquid transmits heat generated from the cathode ray tube to the metallic frame so as to serve as a cooling medium. Preferably, the air or expansion chamber is located at a position remote from the front surface of the cathode ray tube, and permits expansion in a direction other than along an axis of the tube.

The metallic frame comprises a first spacer formed with inner and outer flanges and a rearwardly extending recess, mating with a second spacer. The inner flange of the first spacer is sealably attached to a front surface periphery of the cathode ray tube, while the second spacer is formed with inner and outer flanges. The inner flange of the second spacer is sealably secured on the rear surface periphery of the lens, while the outer flange of the second spacer is sealably connected to the outer flange of the first spacer so as to form a hollow metallic frame.

A transparent intermediate panel is located between the front panel of the cathode ray tube and the lens to absorb x-rays emitted from the fluorescent substance on the cathode ray tube. Thus, the thickness of the front panel of the tube may be reduced to further improve the cooling effect.

The apparatus further comprises a temperature switch mounted on the metallic frame for detecting temperature of the transparent liquid to turn off the power supply of the cathode ray tube, or to reduce the cathode current supplied to the cathode ray tube to protect the apparatus from high temperature. The temperature switch detects a predetermined temperature which is related to, but less than, the deformation temperature of the lens.

In the foregoing embodiment, preferably the refractive index of the intermediate panel is substantially equal to the refractive indices of the cathode ray tube front panel, the lens, and the transparent medium for providing high luminance and high contrast images.

In operation, the cathode ray tube apparatus according to the invention provides a reservoir location for an increase in volume of the transparent cooling liquid or medium caused by thermal expansion at a high temperature of the cathode ray tube. Thus, the apparatus may be continuously operated for a long period of time so that, despite a rise in temperature, deformation of the apparatus causing a change in the distance between the front surface of the tube and the lens is eliminated. Such a cathode ray tube according to the present invention is thus explosion-proof and can continue to provide clear, focused, optical images without exhibiting thermal extinguishment or white unbalance.

These and other features and advantages of the invention will become apparent from a detailed description of the preferred embodiment.

BRIEF DESCRIPTION OF THE DRAWINGS

The features and advantages of the cathode ray tube apparatus according to the present invention over the prior art apparatus described herein will be more clearly appreciated from the following description of the preferred embodiment of the invention taken in conjunction with the accompanying drawings, in which like reference numerals designate the same or similar elements, and in which.

DETAILED DESCRIPTION OF THE PREFERRED EMBODIMENT

To facilitate an understanding of the features and advantages as well as the structure of the present invention, a brief reference will be made to a prior cathode ray tube apparatus of the type disclosed in Japanese Unexamined Published Utility Model Application No. 59-7731, with reference to the attached drawing.

Figure 1:
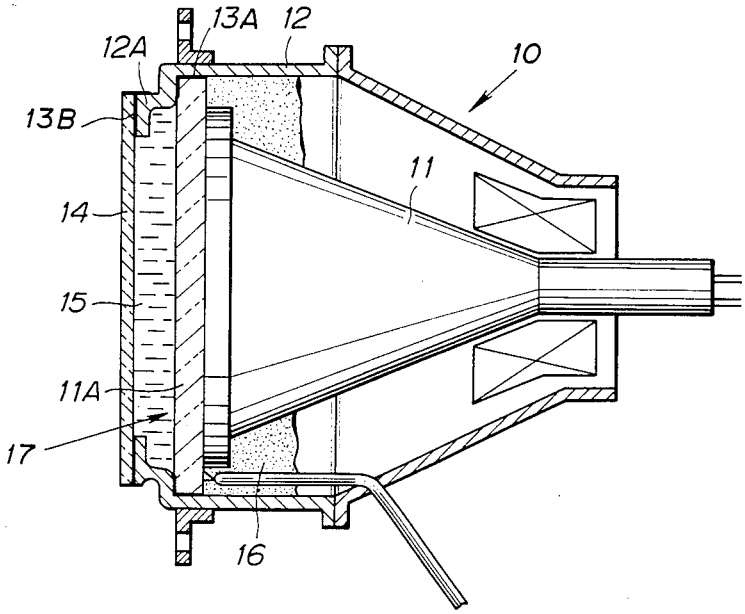
FIG. 1 (PRIOR ART)
FIG. 1 is a cross-sectional side view of a prior art cathode ray tube apparatus.

As seen in FIG. 1, in FIG. 1, a cathode ray tube apparatus is designated generally by the reference numeral 10. The apparatus 10 includes a cathode ray tube 11 in contact with a front panel 11A having a fluorescent surface on its inner side to which a fluorescent substance is applied. A metallic frame 12 is attached to the front surface periphery of the cathode ray tube 11 by way of a sealing member 13A made from a suitable sealing material, such as a silicone resin. The metallic frame 12 is formed with a flange portion 12A surrounding the periphery of the front surface and radially inwardly extending to secure a transparent panel 14 by way of another sealing member 13B.

A cooling medium 15 substantially fills a cooling medium space 17 formed and defined by the front panel 11A of the cathode ray tube 11, the flange portion 12A of the metallic frame 12, and the transparent panel 14. Typically, the cooling medium 15 is ethylene glycol. A filler 16 is disposed between the cathode ray tube and the metallic frame, rearward of the front panel 11A. The operation of such an apparatus is known to the art.

In the cathode ray tube apparatus 10 shown in FIG. 1, the cooling medium 15 substantially fills the cooling medium space 17 in contact with the front panel 11A. As the front panel 11A is heated when the cathode ray tube 11 is in operation, the heat at the front panel 11A is transmitted to the metallic frame 12 by way of the cooling medium 15 and then emitted from the metallic frame 12 to the outside. Therefore, if the front panel 11A of the cathode ray tube 11 rises in temperature because of continuous operation of the cathode ray tube 11, the front panel 11A is effectively cooled to prevent the fluorescent substance applied to the front panel 11A from being peeled off or disengaged. Thus, the white balance of an optical image is prevented from being deteriorated due to thermal extinguishment.

In the cathode ray tube apparatus 10 as described above, however, the temperature of the cooling medium 15 increases with increasing temperature of the front panel 11A. Thus, the volume of the cooling medium 15 inevitably expands. Since a sufficient quantity of cooling medium is used to enhance the cooling effect of the front panel 11A and the cooling medium 15 substantially fills the defined space 17, a danger exists that the cathode ray tube apparatus 10 may explode due to an expansion in volume of the cooling medium 15 within the confined space 17 caused by its temperature rise. Furthermore, even if the cathode ray tube apparatus is not exploded due to the volume expansion of the cooling medium 16 caused by its temperature rise, a risk occurs that the front panel 11A, the metallic frame 12, and the transparent panel 14 are readily deformed. Such a deformation results in a change in the distance between the front panel 11A and the transparent panel 14 along an axis of the tube 11. Therefore, when a lens is attached in place of the transparent panel 14, an optical image on a remote screen becomes unfocused.

Figure 2:
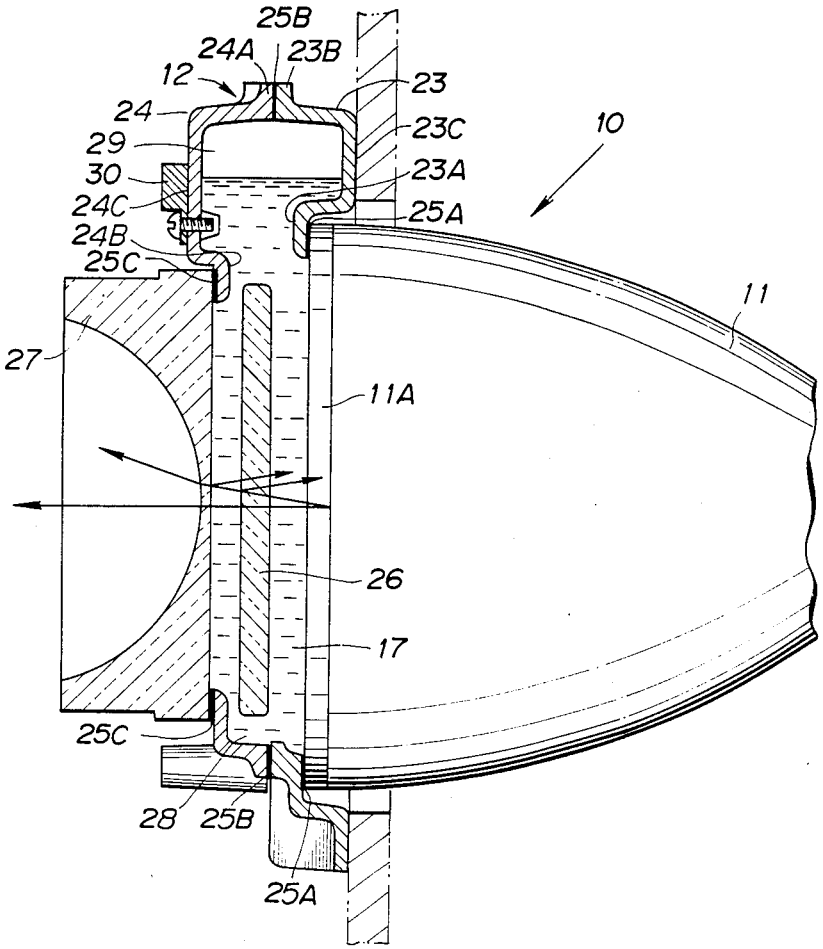
FIG. 2 is a side cross-sectional view showing an embodiment of the cathode ray tube apparatus according to the present invention.
Figure 3:
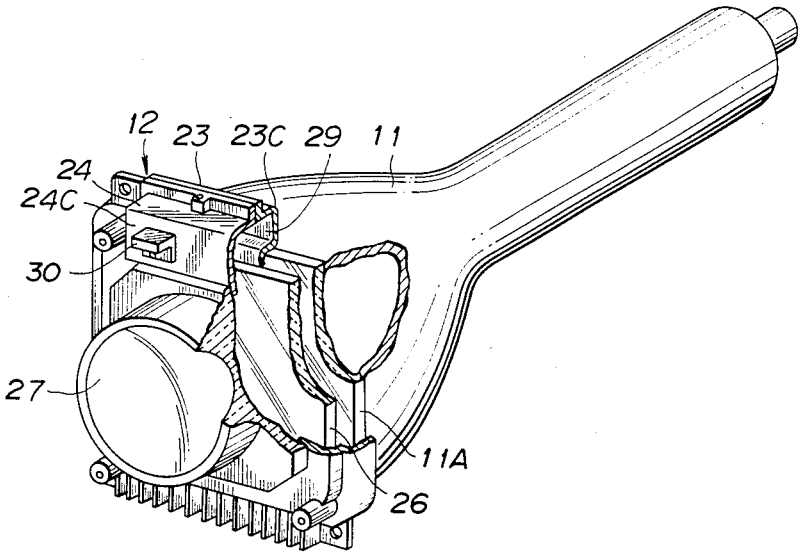
FIG. 3 is a perspective view, partially broken away, of the cathode ray tube apparatus shown in FIG. 2.
Figure 4:
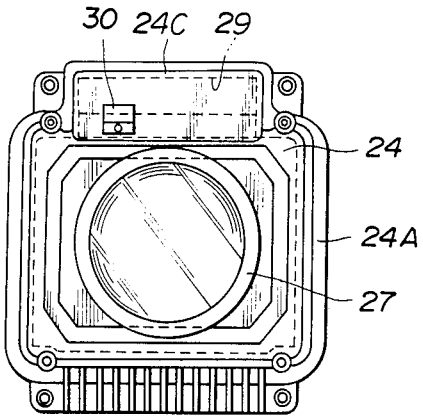
FIG. 4 is a front view of the cathode ray tube apparatus shown in FIG. 2.

In view of the above description, reference is now made to the preferred embodiment of the apparatus 10 according to the invention, as shown in FIGS. 2 to 4.

In FIGS. 2 to 4, a cathode ray tube 11 includes a front panel 11A. The cathode ray tube 11 is made of a glass having a refractive index $n=1.52$ and the panel 11A is formed with a fluorescent surface to the inner side of which a fluorescent substance is applied. A metallic frame 12 is made up of first and second spacers 23 and 24. Each of the spacers 23 and 24 is made from an iron plate on which nickel is plated. Each of the spacers 23 and 24 is formed with a pair of flange portions 23A, 23B or 24A, 24B surrounding the metallic frame 12 to define respectively a forwardly recessed portion 24C and a rearwardly recessed portion 23C. Thus, the spacer 23 includes a flange portion 23A, a rearwardly recessed portion 23C, and a flange portion 23B formed in a continuous structure. Similarly, the spacer 24 includes a flange portion 24A, a rearwardly recessed portion 24C, and a flange portion 24B formed in a continuous structure wherein the flange portions 23A and 24B are spaced closer together when the frame is assembled than are the recessed portions 23C and 24C.

The flange 23A of the spacer 23 is sealingly secured to the front surface periphery of the cathode ray tube 11 by use of a sealing member 25A such as a silicone resin. The flange portion 23B of the spacer 23 is sealingly secured to the adjacent flange portion 24A of the second spacer 24 by another sealing member 25B. When so assembled, the spacers 23 and 24 are configured so that the recessed portions 23C and 24C define a chamber 29 opening through the space defined by the flanges 23A and 24B into the space 17 forward of the front panel 11A of the cathode ray tube 11 and rearward of a lens 27.

That space 17 contains a transparent intermediate panel 26 disposed between the first and second spacers 23, 24 and is made of a material which absorbs x-rays. For example, a suitable material is available under the brand name GLASS FT-22 from Nihon Denki Garasu Co., Ltd., and is suitable for a CRT funnel having a refractive index n=1.54. The diameter of the intermediate panel 26 is greater than that defined by the location of the aperture of the flange portion 24B of the spacer 24.

The transparent intermediate panel 26, because it can absorb x-rays, permits the thickness of the panel 11A to be reduced consistent with requirements of strength. Thus, the front panel 11A may be thinner and thus more effective in cooling the apparatus.

The lens 27 is sealingly secured to the flange portion 24B of the spacer 4 on the metallic frame 2 by another sealing member 25C. The lens is preferably made of an acrylic resin having a refractive index of n=1.49.

According to the invention, a transparent cooling liquid medium 28 is located in a space formed by the cathode ray tube 11, the metallic frame 12, and the lens 27. The cooling medium 28 is preferably liquid ethylene glycol, in a mixture of 80% ethylene glycol and 20% water for example, in a quantity so that about 90% of the volume of the total space defined by the space 17 and the chamber 29 is filled with the cooling medium 28 and about 10% of the volume of the space is provided with air, so as to form an air chamber 29 acting as an expansion chamber or reservoir for the cooling liquid 28.

The cooling medium 28 is injected from an inlet port (not shown) disposed at the periphery of the metallic frame 12. After injection of the cooling medium 28, the inlet port is closed by a rubber plug and sealed by a resin. Preferably, the air chamber 29 is formed so that the liquid surface of the cooling medium 28 (or the liquid-air interface) lies radially outwardly of the front panel 11A and the lens 27, even if the cathode ray tube appratus is inclined at a predetermined angle. Thus, the space 17 forward of the front panel 11A of the cathode ray tube apparatus 10 is always sufficiently filled with cooling liquid 28 to preserve the optical integrity of the system, regardless of the orientation of the tube 11.

In the cathode ray tube apparatus of the present invention constructed as described above, significant advantages accrue. When the temperature of the front panel 11A rises after the cathode ray tube 1 has been operated for a long period of time, the heat generated at the front panel 11A is transmitted to the metallic frame 12 by the cooling medium 28 and then emitted from the metallic frame 12 to the outside. Since the volume of the cooling medium 28 which is expanded due to a temperature rise is absorbed by compression of the air contained in the air chamber 29, the distance between the front panel 11A and the lens 27 remains constant and will not change. Thus, it is possible to project in-focus images on the screen so that a clear optical image can be obtained. The location of the air chamber 29 relative to the cooling fluid 28 thus permits expansion of the cooling medium 28 in a radial direction relative to the axis of the cathode ray tube, permitting the distance between the front panel 11A of the cathode ray tube 1 and the interior surface of the lens 27 to remain constant despite expansion of the fluid 28.

Furthermore, with this configuration of the apparatus according to the invention, x-rays emitted from the front panel 11A are absorbed by the metallic frame 12 and the intermediate panel 26 so that substantially all of the x-rays are not emitted to the outside from the apparatus.

According to the invention, since the refractive indices of the front panel 11A, the intermediate panel 26, the lens 27 and the cooling medium 28 are approximately equal to each other, light reflected from each boundary area, as depicted generally by the arrows shown in FIG. 2, is slight. Thus, it is possible to obtain optical images of a high luminance and a high contrast ratio.

With the apparatus shown in FIGS. 2–4, heat generated at the front panel 11A is effectively emitted from the metallic frame 12 thus avoiding the phenomenon of thermal extinguishment on the fluorescent surface of the front panel 11A, while maintaining the white balance at a constant level on the optical image.

Optionally, a temperature switch 30 is mounted on the second spacer 24 to detect the temperature of the cooling medium 28. Such a temperature switch may be used in a circuit (not shown) to turn off the power supply of the cathode ray tube apparatus or to reduce the cathode current to a predetermined portion of its original value. When such a protection circuit is additionally provided, the temperature switch can detect a temperature slightly lower than 100° C. at which the lens 27 is deformed. The temperature actually detected by the switch 30 may be other than 100° C. and is that temperature obtained when the lens 27 is at about 100°. Such a predetermined temperature when used in a thermal circuit prevents the lens 27 from being deformed due to an abnormally high temperature when the cathode ray tube apparatus is continuously operated for many hours.

The apparatus may be embodied in other embodiments. For example, if the spacers 23, 24 are formed to include additional recessed portions like recesses 23C, 24C on the lower side of the tube 11 (opposite to and in addition to those shown in FIG. 2) and the temperature switch 30 is attached to the lower side of the frame 12, the cathode ray tube apparatus 10 may be used upside down in a suspended type installation.

The invention may be embodied in other specific forms without departing from its spirit or essential characteristics. The present embodiments are, therefore, to be considered in all respects as illustrative and not restrictive, the scope of the invention being indicated by the claims rather than by the foregoing description, and all changes which come within the meaning and range of the equivalents of the claims are therefore intended to be embraced therein.

What is claimed is:

1. A cathode ray tube apparatus which comprises:

a cathode ray tube defining a field of view;

a thermally conductive frame mounted on a front surface periphery of said cathode ray tube and located adjacent its field of view; and a transparent member connected on a front surface periphery of said thermally-conductive frame so that a front surface of said cathode ray tube, a portion of said frame, and a rear surface of said transparent member together define a space for housing a cooling medium therein;

said frame further defining an expansion chamber outside of the field of view of said tube for said cooling medium, said expansion chamber communicating with said space so that a portion of said cooling medium is received in a portion of said expansion chamber upon thermal expansion of said cooling medium in said space during operation of said cathode ray tube for any circumferential orientation of said tube.

2. The apparatus as set forth in claim 1, further including a volume of cooling medium in said space and a portion of said expansion chamber, a remaining portion of said expansion chamber being free to receive an expanded volume of said cooling medium.

3. The apparatus as set forth in claim 2, wherein said cooling medium includes ethlylene glycol.

4. The apparatus as set forth in claim 3, wherein said cooling medium comprises a mixture of about 80 percent ethylene glycol and about 20 percent water.

5. In a cathode ray tube apparatus comprising a cathode ray tube having a front panel defining a field of view, a thermally conductive frame secured to a front surface periphery of said tube adjacent to said field of view, and a transparent member secured to a front surface of said frame, an improvement wherein said frame defines an expansion chamber for thermal expansion of a cooling medium in communication with a cooling medium space defined within said field of view by the front panel of said cathode ray tube, a portion of said frame, and a rear surface of said transparent member, said expansion chamber being located outside of said field of view of said cathode ray tube whereby said expansion chamber accommodates thermal expansion of a volume of said cooling medium in a direction away from said field of view.

6. The apparatus as set forth in claim 5, further including a volume of cooling medium in said space and a portion of said expansion chamber, a remaining portion of said expansion chamber being free to receive an expanded volume of said cooling medium.

7. The apparatus as set forth in claim 6, wherein said cooling medium includes ethylene glycol.

8. The apparatus as set forth in claim 7, wherein said cooling medium comprises a mixture of about 80 per cent ethylene glycol and about 20 percent water.

9. The apparatus as set forth in claim 5, further including an x-ray absorbing intermediate member located intermediate said cathode ray tube and said transparent member.

10. The apparatus as set forth in claim 5, wherein said intermediate member is a lens.

11. The apparatus as set forth in claim 10, wherein the refractive indices of said front panel of said cathode ray tube, said lens, said cooling medium, and said transparent member are about equal.

12. The cathode ray apparatus as set forth in claim 11, wherein said metallic frame comprises:

(a) a first spacer having an inner flange, an outer flange, and a reqrwardly extending recessed portion, the inner flange being sealably secured to the front surface periphery of said cathode ray tube; and (b) a second spacer having an inner flange, an outer flange, and a forward extending recessed portion the inner flange being sealably secured to the rear surface periphery of said lens and the outer flanges of said first and second spacers being sealably connected to each other, said recessed portions defining said expansion chamber.

13. The cathode ray tube apparatus as set forth in claim 10, further comprising a transparent intermediate panel disposed between the front surface of said cathode ray tube and the rear surface of said lens for absorbing x-rays emitted from a fluroescent substance applied onto a front inner surface of the cathode ray tube.

14. The cathode ray tube apparatus as set forth in claim 5, further comprising a temperature switch mounted on said metallic frame for detecting temperature of said cooling liquid to turn off a power supply of the cathode ray tube or to reduce a cathode current passed through the cathode ray tube for protection of the apparatus from high temperature.

15. The cathode ray tube apparatus as set forth in claim 14, wherein a refractive index of said transparent intermediate panel is substantially equal to those of the front surface of said cathode ray tube, said lens and said cooling medium, in order to provide high luminance and high contrast optical images.

16. A frame for a cathode ray tube apparatus which includes a cathode ray tube defining a field of view and a front transparent panel for projecting color images, said frame comprising:

a first portion adjacent said field of view defining, together with a front surface of said cathode ray tube and an inner surface of said front transparent panel, a cooling medium space for containing a heat-transmissive cooling medium in said space for cooling said cathode ray tube by transferring heat from said cathode ray tube for dissipation by said frame, and a second portion outside of said field of view defining an expansion chamber for said cooling medium in communication with said cooling medium space for accommodating thermal expansion of said cooling medium in said expansion chamber.

17. The apparatus as set forth in claim 16, wherein the relative volumes of said cooling medium space and said expansion chamber are determined relative to a quantity of cooling medium sufficient to cool said cathode ray tube under prolonged operation so that the cooling medium always fills said space regardless of the orientation of said apparatus.

18. The apparatus as set forth in claim 16, wherein said second portion of said frame comprises:

first and second spacers, each respectively having a first flange portion, a central recessed portion, and a second flange portion, said recessed portions together defining said expansion chamber when said spacers are joined at their respective first flange portions.

19. The apparatus as set forth in claim 18, wherein the second flange portion of said first spacer is sealingly secured to a front surface periphery of said cathode ray tube and the second flange portion of said second spacer is sealingly secured to said front transparent panel, said central recessed portion of said front and second spacers being oppositely directed to define said expansion chamber.

20. The apparatus as set forth in claim 19, wherein said expansion chamber communicates with said cooling medium space through an area defined by a distance between the respective second flange portions of said first and second spacers.

* * * * *